US005767761A

United States Patent [19]

Muramatsu et al.

[11] Patent Number: 5,767,761

[45] Date of Patent: Jun. 16, 1998

[54] FUSIBLE LINK CONNECTION BOX

[75] Inventors: Kenji Muramatsu; Toshiharu Kudo, both of Shizuoka, Japan

[73] Assignee: Yazaki Corporation, Tokyo, Japan

[21] Appl. No.: 635,405

[22] Filed: Apr. 26, 1996

[30] Foreign Application Priority Data

Apr. 26, 1995 [JP] Japan ..... 7-102268

[51] Int. Cl.[6] ..... H01H 85/02

[52] U.S. Cl. ..... 337/197; 337/198; 337/186; 361/833

[58] Field of Search ..... 337/4, 142, 186, 337/197, 198, 208, 231, 398; 361/833, 834, 837

[56] References Cited

U.S. PATENT DOCUMENTS 5,345,211 9/1994 Muramatsu et al. ..... 337/186

5,488,345 1/1996 Seki et al. ..... 337/186

*Primary Examiner*—Leo P. Picard

*Assistant Examiner*—Jayprakash N. Gandhi

*Attorney, Agent, or Firm*—Sughrue, Mion, Zinn, Macpeak & Seas, PLLC

[57] ABSTRACT

In a fusible link connection box, a pair of through holes through which terminal legs of a large male fusible link are to be respectively passed are opened in the bottom of a rectangular cup-like portion which is disposed in the upper portion of the base body, and a pair of terminal pieces to which a small female fusible link is to be connected are disposed within the through holes. The terminal pieces protrude from the upper ends of bus bars which are fastened together with lead wire terminals to terminal nuts which are attached to the sides of a center wall. The center wall vertically downward elongates from the bottom.

4 Claims, 4 Drawing Sheets

FUSIBLE LINK CONNECTION BOX

BACKGROUND OF THE INVENTION

1. Field of the Invention

The invention relates to a fusible link connection box, and particularly to a fusible link connection box which is excellent in versatility or applicable to at least two kinds of fusible links that are used for protection of a power source circuit of a vehicle or the like and that have different external dimensions.

2. Related Art

Fusible links are used for protecting electric systems of electric appliances mounted on an automobile or the like. Conventionally, various kinds of fusible links having different external dimensions have been standardized depending on the rated current. In high-grade automobiles, particularly, plural kinds of fusible links are used for one automobile. Therefore, fusible link connection boxes for two or more kinds of dimensions must be connected between electric appliances and a battery power source.

FIG. 7 is a section view of a conventional art connection box for a large male fusible link. The fusible link connection box 51 comprises a rectangular cup-like portion 56. A pair of narrow through holes 53 which are parallel to each other are opened in the bottom 52 of the cup-like portion 56 so that terminal legs 42 of a large male fusible link 41 are attached. The fusible link connection box 51 further comprises: a center wall 57 which vertically downward elongates from the lower face of the rectangular cup-like portion 56 and along the through holes 53, and which have terminal nuts 46 respectively disposed on the wall faces; and bolts 47 which are to be screwed into the terminal nuts 46, respectively. Lead wire terminals 45 are to be connected to the nuts 46, respectively.

FIG. 5 is a perspective view of the large male fusible link. In the male fusible link 41, a pair of parallel terminal legs 42 vertically downward elongate with a clearance Z1, from the lower face of a housing 43 which houses a fuse and which is made of a synthetic resin. An inverted U-like cutaway portion 44 is formed in each of the terminal legs 42, and a flange **42*a* which is inward directed is formed at each side end of each of the terminal legs 42**.

FIG. 6 is a perspective view of a small female fusible link. A pair of parallel terminal holes 49 are opened with a clearance Z2 in the lower face of the female fusible link 48. The clearance Z2 is smaller than the clearance Z1 of the large male fusible link 41.

In the thus configured fusible link connection box 51, firstly, the terminal legs 42 of the male fusible link 41 are positioned by the through holes 53 of the bottom 52 and then fitted into the cup-like portion 56, so that the housing 43 of the male fusible link 41 is guided by the peripheral wall 54 to abut against the bottom 52. Since the cutaway portions 44 are formed, the terminal legs 42 can be fitted between the lead wire terminals 45 and the terminal nuts 46, without interfering with the bolts 47. Thereafter, the terminal legs 42 and the lead wire terminals 45 are fastened together by the bolts 47.

In the fusible link connection box, therefore, the male fusible link 41 is electrically connected to the lead wire terminals 45 and also mechanically firmly secured. As a result, it is possible to obtain a fusible link connection box which is resistant to vibration of a vehicle and which has excellent reliability.

In the conventional art fusible link connection box 51, the large male fusible link 41 can be connected, but the small female fusible link 48 cannot be connected because protruding terminals for connecting such a small female fusible link are not formed on the bottom 52.

Consequently, it is required to separately prepare a connection box dedicated for the large male fusible link 41 which generally has a large capacity, and that for the small female fusible link 48 which generally has a small capacity. This produces problems in production cost and workability.

SUMMARY OF THE INVENTION

The invention has been conducted in view of the problems. It is an object of the invention to provide a fusible link connection box to which a large male fusible link and a small female fusible link can be commonly connected.

The object of the invention can be attained by a fusible link connection box, comprising: a pair of through holes through which terminal legs of a large male fusible link are to be respectively passed, the through holes being opened in a bottom of a rectangular cup-like portion which is disposed in an upper portion of the connection box; and a center wall which vertically downward elongates from a lower face of the rectangular cup-like portion and along the through holes, a terminal nut to which a lead wire terminal is to be connected being attached to each side of the center wall, wherein a pair of bus bars having a terminal piece for connecting a small female fusible link to the connection box are respectively connected to the terminal nuts, the terminal pieces being respectively disposed at upper ends of the bus bars and upward protruding from inner sides of the through holes of the bottom.

Moreover, the object of the invention can be attained by fitting the terminal pieces into an interference preventing portion disposed in a lower face of the large male fusible link having the terminal legs which are to engage with the through holes.

Furthermore, the object of the invention can be attained by disposing a spacer for guiding and holding the small female fusible link into the rectangular cup-like portion.

According to the fusible link connection box of the invention, the bus bars from each of which the terminal piece for connecting a small female fusible link upward protrudes from the inner side of the respective one of the through holes of the bottom of the rectangular cup-like portion are connected to the terminal nuts, respectively.

Consequently, a large male fusible link can be connected by fitting its terminal legs into the through holes of the bottom, and a small female fusible link can be connected by fitting its terminal holes onto the terminal pieces protruding from the bottom. As a result, the fusible link connection box can be commonly used for the two kinds of fusible links, thereby improving the working efficiency and reducing the production cost.

The terminal pieces of the bus bars are fitted into the interference preventing portion which is disposed in the lower face of the large male fusible link having the terminal legs engaging with the through holes. In other words, when the large male fusible link is connected, the terminal pieces for a small female fusible link are fitted into the interference preventing portion of the male fusible link.

Consequently, the large male fusible link is connected more firmly so that the reliability of the fusible link connection box is further improved.

A spacer for guiding and holding a small female fusible link into the rectangular cup-like portion is disposed. In other words, when the small female fusible link is connected to the fusible link connection box, the spacer is inserted into the cup-like portion. Therefore, the small female fusible link is guided by the spacer and held more stably, thereby further improving the workability and the reliability.

DETAILED DESCRIPTION OF THE PREFERRED EMBODIEMTNS

Figure 1:
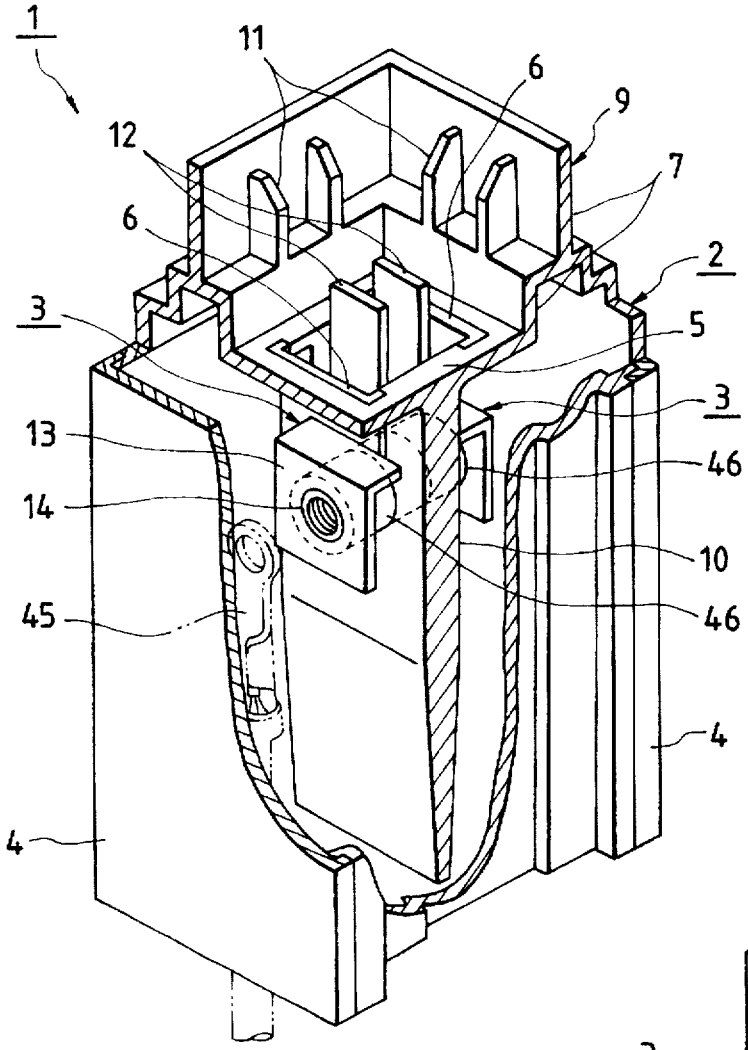
FIG. 1 is a perspective view showing an embodiment of the fusible link connection box of the invention.
Figure 2:
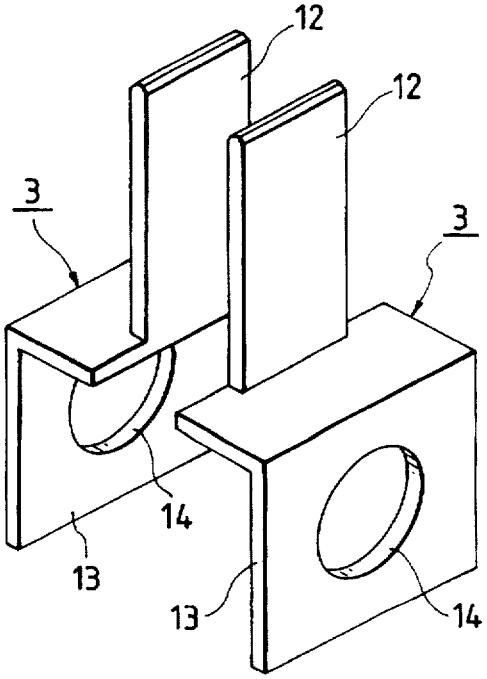
FIG. 2 is a perspective view of bus bars shown in FIG. 1.
Figure 3:
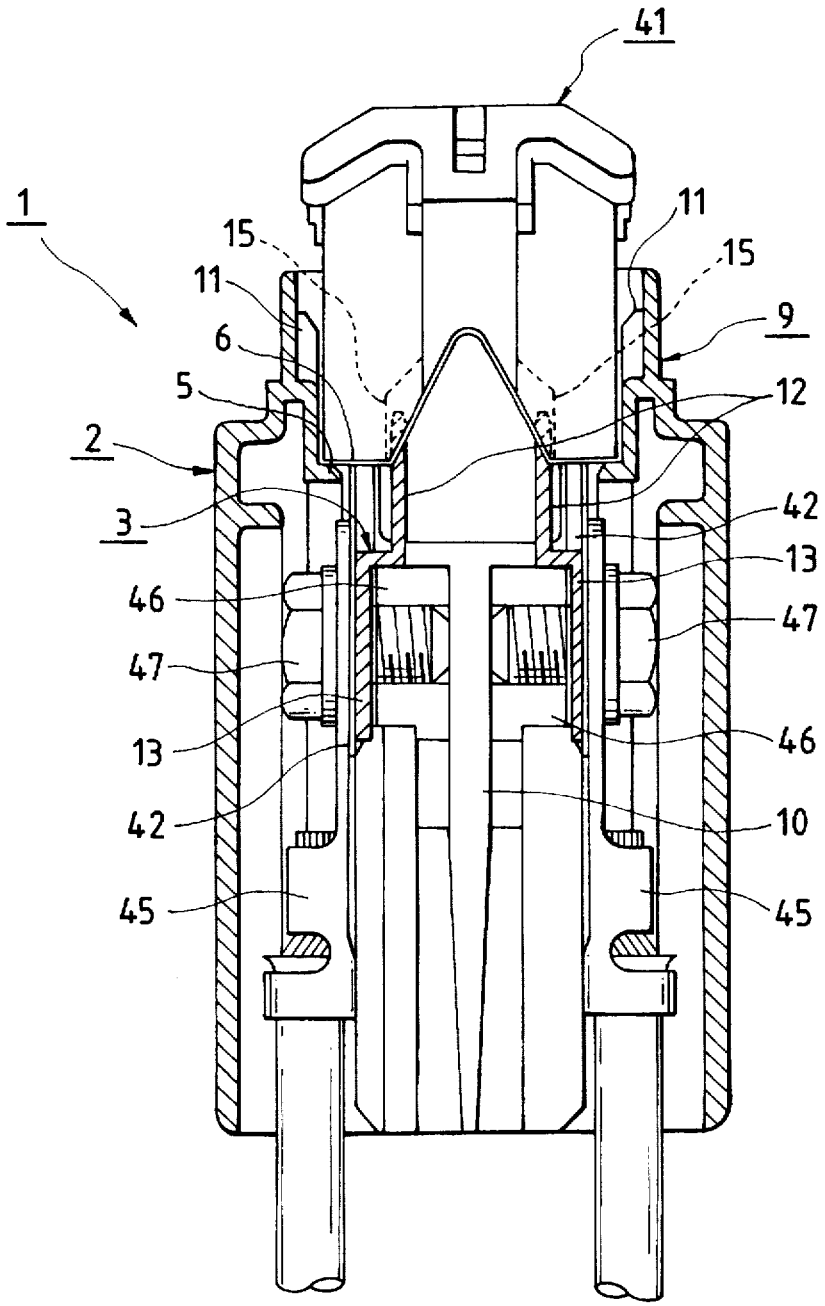
FIG. 3 is a section view showing the state where a male fusible link is connected to the connection box of FIG. 1.
Figure 4:
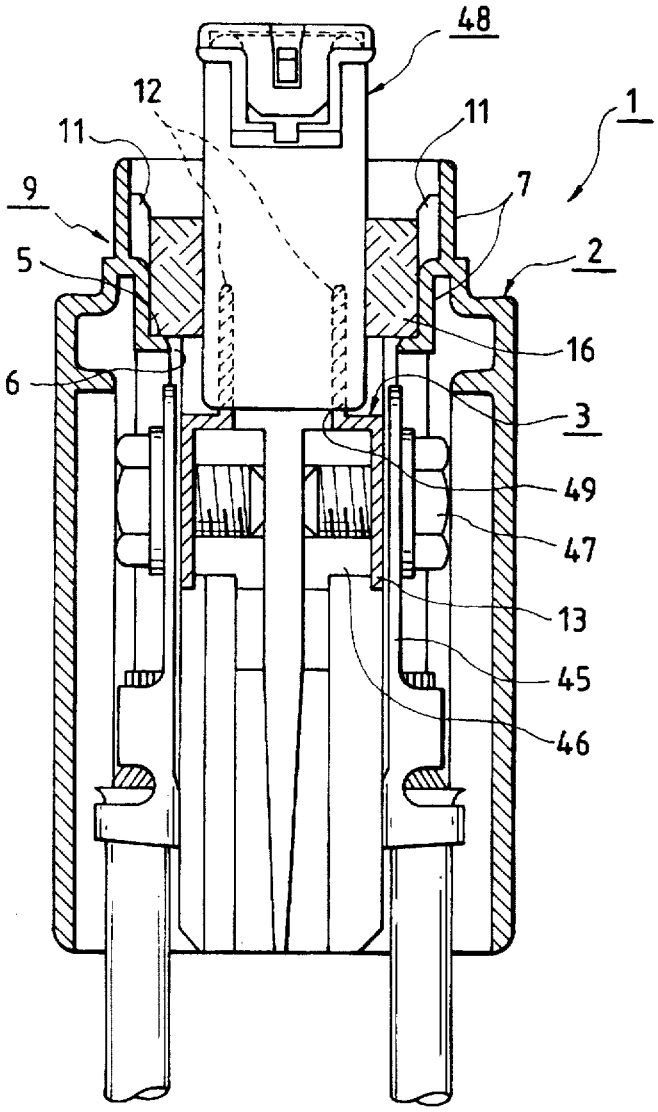
FIG. 4 is a section view showing the state where a female fusible link is connected to the connection box of FIG. 1.
Figure 5:
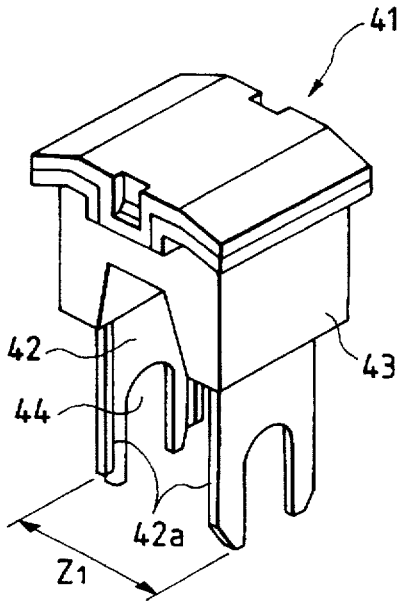
FIG. 5 is a perspective view of a large male fusible link.
Figure 6:
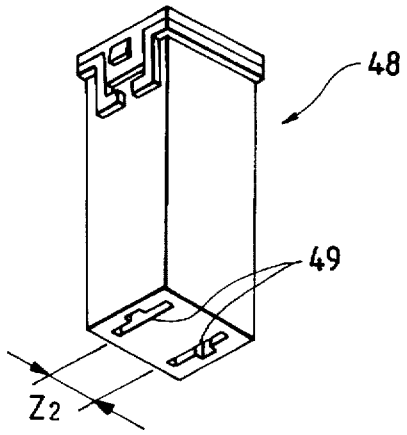
FIG. 6 is a perspective view of a small female fusible link.
Figure 7:
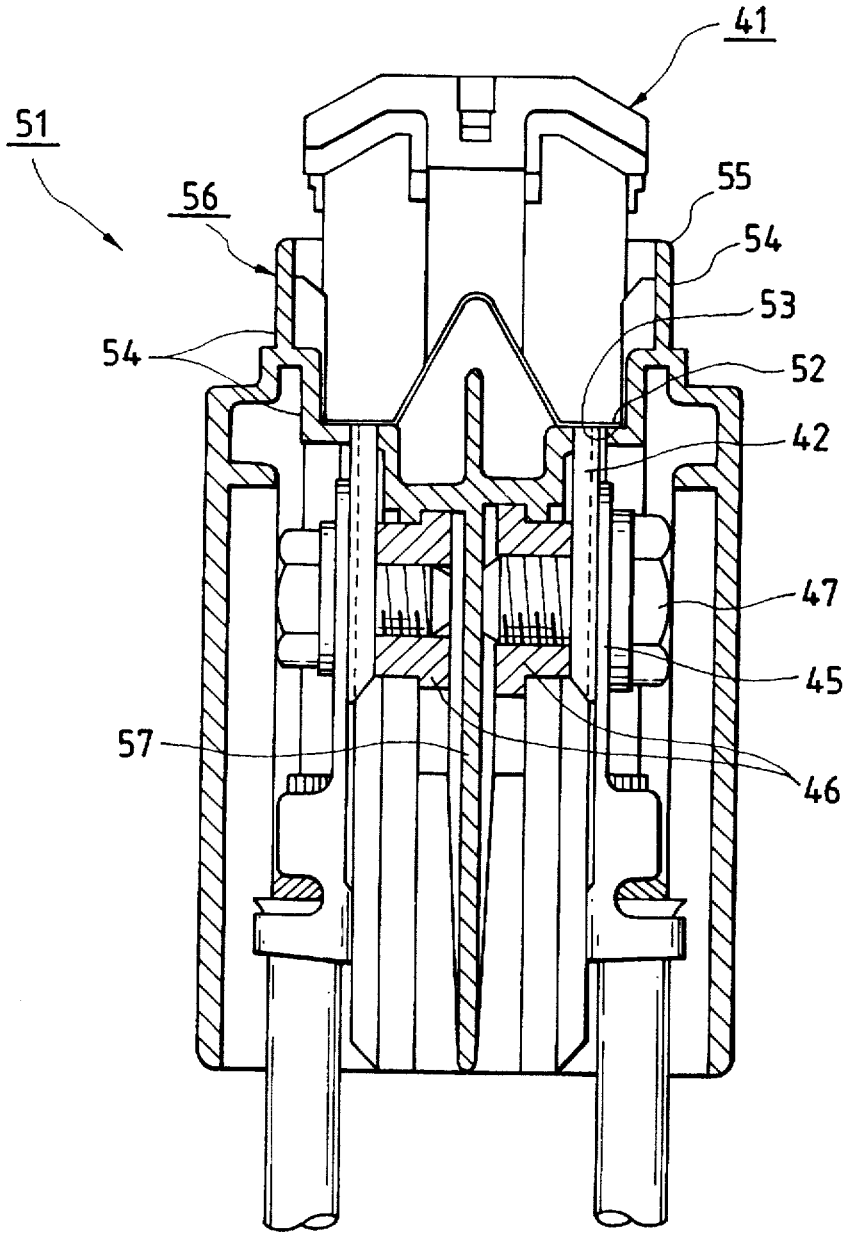
FIG. 7 is a section view of a conventional art connection box for a male fusible link.

Hereinafter, an embodiment of the fusible link connection box of the invention will be described with reference to FIGS. 1 to 4. FIG. 1 is a perspective view showing an embodiment of the invention, in partial section, FIG. 2 is a perspective view of bus bars shown in FIG. 1, FIG. 3 is a section view showing the state where a male fusible link is connected to the fusible link connection box of FIG. 1, and FIG. 4 is a section view showing the state where a female 5 fusible link is connected to the fusible link connection box of FIG. 1.

As shown in FIG. 1, the fusible link connection box 1 comprises the base body 2 made of a hard synthetic resin, the bus bars 3, terminal nuts 46, bolts 47 which are screwed into the terminal nuts 46, and a body cover 4.

In the base body 2, a pair of narrow through holes 6 which are parallel to each other and to which terminal legs 42 of the large male fusible link 41 are to be attached are opened in the bottom 5 of a rectangular cup-like portion 9.

A center wall 10 which vertically downward elongates from the lower face of the cup-like portion 9 and along the through holes 6 is disposed. The pair of terminal nuts 46 to which lead wire terminals 45 are to be connected are attached to the side faces of the center wall, respectively.

Guide ribs 11 for guiding the male fusible link 41 are formed within the side wall 7 constituting the cup-like portion 9.

The body cover 4 which protects the lead wire terminals 45, etc. and which can be opened as required is disposed on the side faces of the base body 2.

In order to connect the small female fusible link 48, terminal pieces 12 are disposed within the through holes 6 so as to protrude from the bottom 5 of the cup-like portion 9. As shown in FIG. 2, the terminal pieces 12 are formed on the upper end portions of the respective bus bars 3. A mounting plate 13 having an insertion hole 14 through which a bolt is to be passed is formed in the lower portion of each of the bus bars 3. The mounting plates 13 of the pair of bus bars 3 are formed so as to respectively abut against the outsides of the terminal nuts 46 (see FIG. 1).

As shown in FIG. 3, an interference preventing portion 15 for preventing the large male fusible link 41 from interfering with the terminal pieces 12 is formed in the lower portion of the fusible link 41. The vertical faces of the interference preventing portion 15 are positioned so that the terminal pieces 12 can be fitted into the interference preventing portion 15.

In the thus configured fusible link connection box 1, when the large male fusible link 41 is to be connected as shown in FIG. 3, the terminal legs 42 are fitted into the respective through holes 6 and the housing 43 is pushed down while being guided by the guide ribs 11.

At this time, the terminal legs 42 are lowered so that the cutaway portions 44 straddle the respective bolts 47, and then fitted between the heads of the bolts 47 and the mounting plates 13 of the bus bars 3. When the bolts 47 are fastened, therefore, the male fusible link 41 is electrically connected to the fusible link connection box 1 and also mechanically firmly secured to the box.

Since the terminal pieces 12 of the bus bars 3 are fitted into the interference preventing portion 15, the large male fusible link 41 is surely prevented from laterally vibrating.

When the small female fusible link 49 is to be connected to the fusible link connection box 1 as shown in FIG. 4, the electrical connection is attained by fitting the terminal holes 49 of the female fusible link 48 onto the terminal pieces 12 of the bus bars 3. In the mechanical view point, the mounting plates 13 of the bus bars 3 is fastened together with the lead wire terminals 45 to the terminal nuts 46 by the bolts 47, with the result that the terminal pieces 12 are firmly secured.

A spacer 16 which is made of rubber, a soft synthetic resin, or the like is attached to the peripheral wall 7 of the cup-like portion 9 and into the guide ribs 11. Therefore, the female fusible link 48 is guided and secured in a further stable state.

As seen from the above description, both the large male fusible link 41 and the small female fusible link 48 can be connected to the one kind of the fusible link connection box 1.

In a working site, therefore, it is not required to select a fusible link connection box in consideration of the capacity. This can improve the working efficiency and attain the reduction of the production cost.

A large or small fusible link is electrically connected to the fusible link connection box 1 and also mechanically firmly secured to the connection box. Consequently, the reliability of the connection box can be further improved.

The invention is not restricted to the embodiment described above. When adequately modified, the invention may be executed in other manners. In the embodiment, for example, the terminal pieces 12 of the bus bars 3 are inserted into the interference preventing portion 15 of the large male fusible link 41. When another spacer is fitted between the terminal pieces 12, the fusible link can be secured further firmly.

As described above, according to the fusible link connection box of the invention, the bus bars each having at the upper end the terminal piece which upward protrudes from an inner side of respective one of the through holes of the bottom of the rectangular cup-like portion are connected to the terminal nuts, respectively.

Therefore, a male fusible link can be connected to the fusible link connection box by fitting the terminal legs into the through holes of the bottom, and a female fusible link can be connected to the fusible link connection box by fitting the terminal holes onto the terminal pieces protruding from the bottom.

Accordingly, the fusible link connection box can be provided with versatility, and hence the working efficiency can be improved and the reduction of the production cost can be attained.

The terminal pieces of the bus bars are inserted into the interference preventing portion disposed in the lower face of the large male fusible link having the terminal legs which are to engage with the through holes.

Therefore, the male fusible link is held more stably and the reliability of the fusible link connection box can be further improved.

The spacer for guiding and holding the small female fusible link into the rectangular cup-like portion is disposed.

Therefore, the small female fusible link is guided by the spacer and held more stably so that the working efficiency is improved and the reliability of the fusible link connection box is further enhanced.

What is claimed is:

1. A fusible link connection box comprising:

a pair of through holes through which terminal legs of a first fusible link are to be respectively passed, said through holes being opened in a bottom of a rectangular cup-like portion which is disposed in an upper portion of said connection box;

a center wall which vertically downward elongates from a lower face of said rectangular cup-like portion and along said through holes, a terminal nut to which a lead wire terminal is to be connected being attached to each side of said center wall; and a pair of bus bars having a terminal piece for connecting a second fusible link to said connection box being respectively connected to said terminal nuts, said terminal pieces being respectively disposed at upper ends of said bus bars and upward protruding from inner sides of said through holes of said bottom.

2. A fusible link connection box according to claim 1, further comprising:

an interference preventing portion into which said terminal pieces are to be fitted is disposed in a lower face of said first fusible link having said terminal legs which are to engage with said through holes.

3. A fusible link connection box according to claim 1, further comprising:

a spacer for guiding and holding said second fusible link into said rectangular cup-like portion.

4. A fusible link connection box according to claim 1, as claimed in claim 1, wherein said bus bar has the stepped portion for holding said second fusible link.

* * * * *